United States Patent [19]

Jackson

[11] Patent Number: 4,860,701

[45] Date of Patent: Aug. 29, 1989

[54] MULTIPLE PISTON EXPANSION CHAMBER ENGINE

[76] Inventor: Francis W. Jackson, 409 Penwyn Rd., Wynnewood, Pa. 19096

[21] Appl. No.: 150,637

[22] Filed: Feb. 1, 1988

Related U.S. Application Data

[60] Division of Ser. No. 924,887, Oct. 30, 1986, Pat. No. 4,741,296, which is a continuation of Ser. No. 727,338, Apr. 25, 1985, abandoned, which is a continuation-in-part of Ser. No. 688,954, Dec. 31, 1984, Pat. No. 4,570,580, which is a continuation-in-part of Ser. No. 647,842, Sep. 6, 1984, Pat. No. 4,580,532, which is a division of Ser. No. 326,902, Dec. 2, 1981, Pat. No. 4,489,681.

[51] Int. Cl.[4] ..... F02B 75/18

[52] U.S. Cl. ..... 123/51 A; 123/312

[58] Field of Search ..... 123/70 R, 312, 52 B, 123/80 BA, 51 A, 53 A

[56] References Cited

U.S. PATENT DOCUMENTS

| | | | |
|---|---|---|---|
| 1,568,431 | 1/1926 | Weger | 123/70 R |
| 1,773,995 | 8/1930 | Goldsborough | 123/74 C |
| 1,802,382 | 4/1931 | Hunter | 123/70 R |
| 2,734,494 | 2/1956 | Waterval | 123/52 B |
| 3,880,126 | 4/1975 | Thurston et al. | 123/70 R |
| 4,157,080 | 6/1979 | Hill | 123/53 B |
| 4,296,714 | 10/1981 | Buchner | 123/53 B |
| 4,434,752 | 3/1984 | Bachmann | 123/52 B |
| 4,565,167 | 1/1986 | Bryant | 123/70 R |

*Primary Examiner*—David A. Okonsky

[57] ABSTRACT

A method of extracting work from two chambers including a working chamber surrounded by a reciprocating sleeve and an auxiliary chamber surrounding the sleeve.

10 Claims, 7 Drawing Sheets

MULTIPLE PISTON EXPANSION CHAMBER ENGINE

This is a divisional process patent application to application No. 924,887 filed 10/30/86 and now 4,741,296 which is a continuation to continuation-in-part process patent application No. 727,338 filed 4/25/85 and now abandoned which is a continuation-in-part to patent application No. 688,954 filed 12/31/84 and now 4,570,580 which is a continuation-in-part to application No. 647,842 filed 9/6/84 and now 4,580,532 which is a divisional to application No. 326,902 filed 12/2/81 and now 4,489,681.

DESCRIPTION OF PRIOR ART

In prior art the balance of many factors has led to cylinder designs with stroke to bore's around 1. Given this stroke to bore and an average piston speed the engine efficiency and weight for a given cylinder horsepower is pretty well set.

SUMMARY

The use of multiple expansion chambers configured to partially expand the combusted charge in the combustion chamber and then to complete the expansion process using a supplemental expansion chamber with chamber isolation designs that when allowing communication between these chambers accomplish the communication with minimal throttling and minimum added wetted perimiter provides attractive improvements.

The smaller diameter initial chamber allows flame speed to not be as restrictive on stroke to bore. This permits, for flame speed considerations, smaller stroke to bore's to be used. Lower stroke to bore's are not accompanied by significantly increased friction losses as only the combustion chamber sees peak chamber pressure while the auxilary chamber(s) with significantly reduced peak pressure requires smaller bearings. Engine heat transfer losses are down. The net result is increased engine efficiency at reduced weight.

BRIEF DESCRIPTION OF DRAWINGS

FIG. 1 shows the invention in a 4 stroke spark ignition engine application. Center reciprocating piston 10 with piston rings 11 and oil ring 12 sealing between said piston 10 and cylinderical wall 13 in which piston 10 moves as it is driven by rotating crank 14 through rod 15 and wrist pin 16. Rod 15 connected to wrist pin 17 through bearing 17 and to crank 14 through bearing 18. Rotating crank 14 is held by working bearing 38. Annular piston 19, with piston rings 20 and oil ring 21 sealing the outer circumference of auxiliary piston 19 and the outer cylinder wall 22 in which auxiliary piston 19 moves as identical displacement cams 23 rotating as crank 14 rotates and with push cam follows bearings 24 and pull cam follows bearings 32 pushing and pulling cam follow rods 26. Said cam follower rods constrained in direction by bearing 27 sliding in bearing housing 28. As the two cam follower rods act in unison and, through wrist pin bearing 29 and wrist pins 30, reciprocate auxiliary piston 19 and at TDC auxiliary mating surface 31 of auxiliary piston 19 seals against the mating surface in the engine head 34. Rotating valve 33 rotating in head 34 commuting carbureated inlet mixture during injestion from the chamber 35 above the auxiliary piston 19 closing the port during the compression and expansion strokes and exposing the chamber above auxiliary piston 19 to the exhaust manifold during exhaust. At about the time auxiliary piston 19 seals spark plug (not shown) ignites the combustable mixture above the working piston. During the time auxiliary piston 19 is sealed against the chamber head vent passage 36 is open, this vents the pressurized charge trapped above the auxiliary piston back to inlet supply. An additional and optional inlet valve 37 above the working piston is shown and improves the ingestion process.

FIGS. 2A, B and C present the displacements of the circular and auxiliary pistons, the exhaust and inlet openings and ignition timing for the configuration defined in FIG. 1, during the 2 revolutions of a 4 stroke SI engine cycle. FIG. 2A depicts the displacement of the center round piston as it moves between TDC and BDC.

FIG. 3 shows the invention using cylinderical pistons in an opposed configuration. Reciprocating piston 201 driven by rod 202 from conventional crank (not shown). Said piston 201 being connected to rod 202 through wrist pin 203 via bearing 204. Piston 201 is reciprocating (see FIG. 2A) in cylinder wall 205 and sealed by pressure rings 206 and oil seal rings 207. Piston 208 is cam driven (to FIG. 1 auxiliary piston profile) through cam followers 209 connected to piston 208 via wrist pin 210 and bearing 211. Piston 208 motion is as shown in FIG. 2B. Piston 201 motion is as shown in FIG. 2A. The vent function described with FIG. 1 is performed by the inlet valve in this configuration.

FIG. 4 shows a cam driven (cam not shown) thin auxiliary piston 400 acting primarily as a valve between the center cylinderical working piston 401 and the outer auxiliary piston 402. Center reciprocating working piston 401 with piston rings 411 and oil ring 412 sealing between said piston 401 and cylinderical wall 413 in which piston 401 moves as it is driven by rotating crank 414 through rod 415 and wrist pin 416. Rod 415 connected to the wrist pin 416 through bearing 417 and to crank 414 through bearing 418. Rotating crank 414 is held by working bearings 440.

Figure 1:
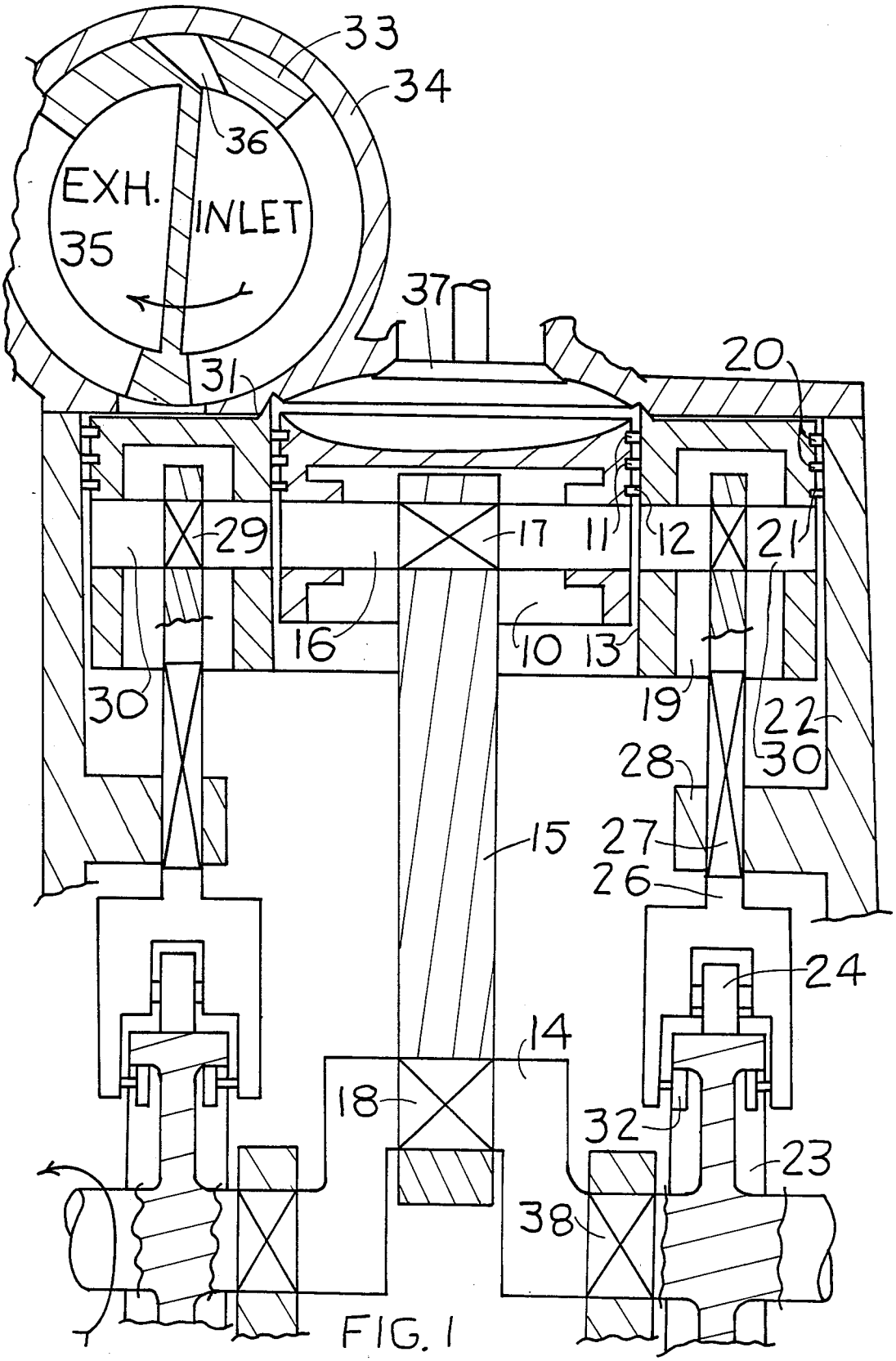
FIG. 1 is a sectional view of one form of the engine.
Figure 2A:
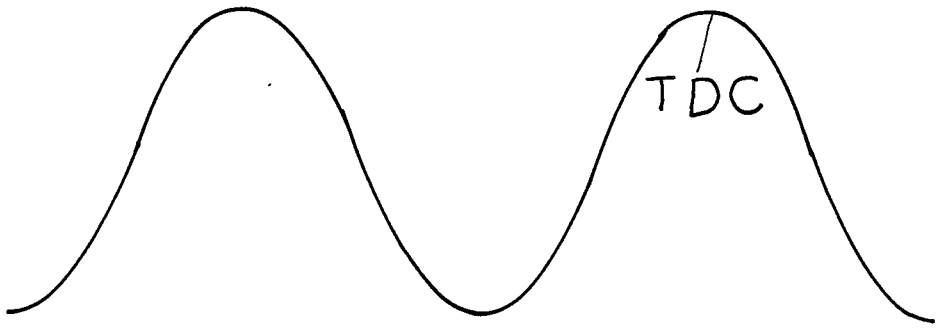
FIGS. 2A, B and C show the relationship in time for the 4 strokes of the working piston displacement, the auxiliary piston displacement, exhaust valve open, inlet valve(s) open and ignition.
Figure 2B:
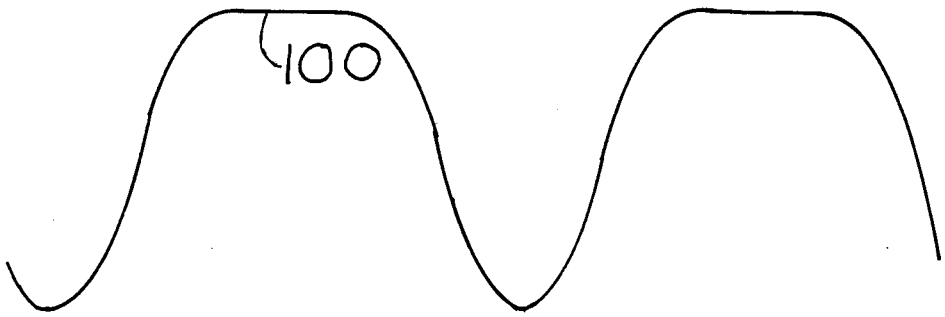
FIG. 2B depicts the auxiliary piston motion with dwells at TDC 100.
Figure 2C:
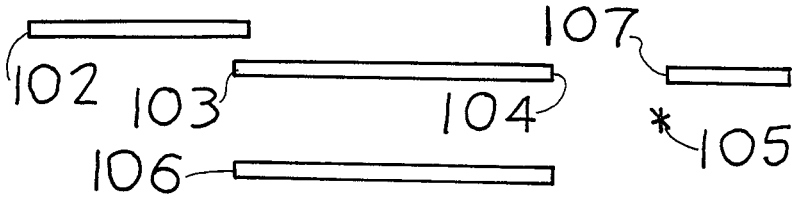
FIG. 2C shows that the exhaust port uncovers as the auxiliary piston approaches BDC 102, inlet port and optional inlet port open 103 and 106 just prior to combined chambers above both pistons, with the exhaust closing immediatly after. This condition continuing until the auxiliary piston is past BDC 104. Ignition 105 occurs at about the time of the sealing of and the head. After the sealing of the auxiliary chamber from the working chamber, the chamber above the auxilliary chamber may be vented, 107, back to supply to reduce the amount of mixture trapped in the auxilliary chamber. Said auxilliary remaining sealed 100 until partial expansion of the charge by the center piston, then at an angle of between 20 and 170 degrees of the center piston crank rotation after TDC the cam mechanism moves the auxiliary piston away from the head breaking the seal and permiting combustion products to flow into the chamber above the auxiliary piston and both pistons now provide expansion.
Figure 3:
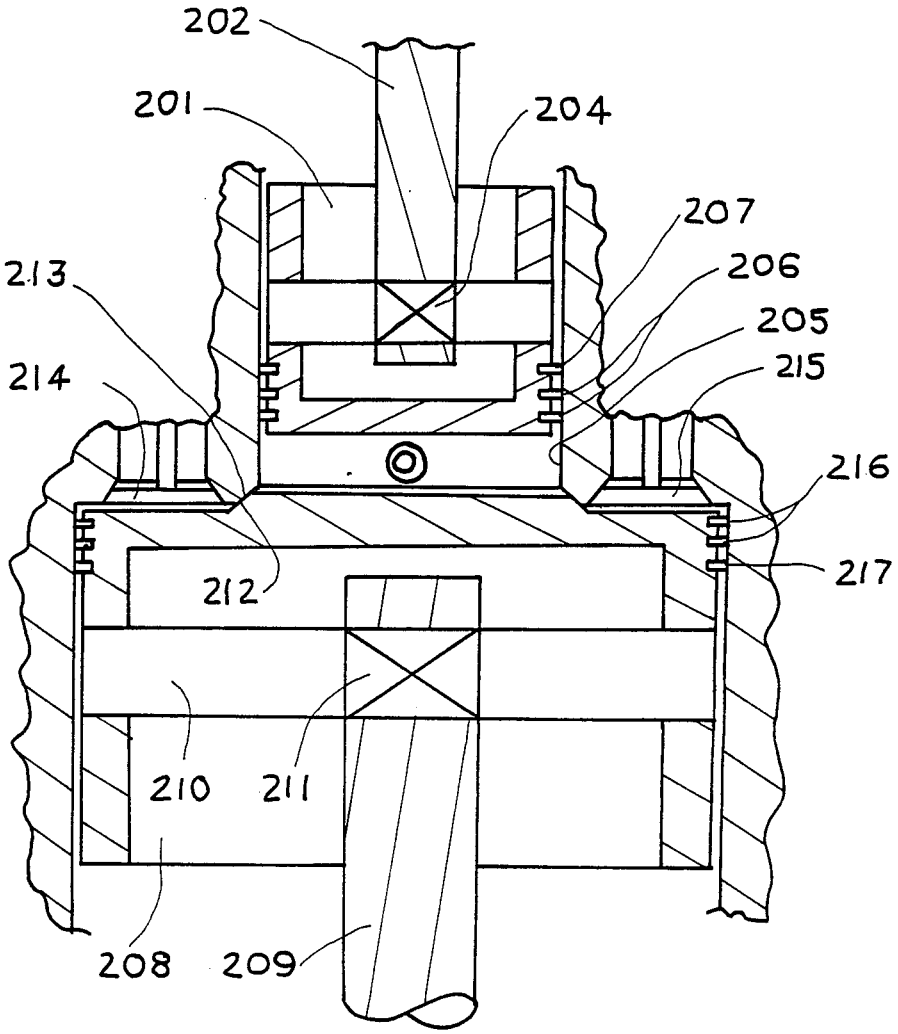
FIG. 3 is a sectional view of another form of the engine.

Valve 400 with piston rings 420 and oil ring 421 sealing the outer circumference of valve 400 and the auxiliary piston 402 in which auxiliary valve 400 moves driven by cam mechanism (not shown) reciprocating auxiliary valve 400 and at TDC circular mating surface 431 of auxiliary valve 400 seal against the mating surface. Twin cranks 403 also on the working crank operating in unison through crank bearings 404 which drive rods 405 through bearings 406 and wrist pin 407, reciprocate auxiliary piston 402 sealed against the outer cylinderical wall 409 through rings 410 and oil seal ring 438. Inlet valve 439 opens about when valve 400 closes and with piston 401 at about TDC. Carbureated charge is forced into the chamber from a pressurized supply or forced in by a properly phased (charging piston at about TDC at about when the inlet valve to the main chamber closes) piston. A rotary exhaust only valve similar to as shown in FIG. 1 and located above the auxiliary piston 402 commutating to the exhaust manifold during exhaust and closed at all other times. Spark plug ignites the combustable mixture about the time inlet valve 439 closes.

Figure 4:
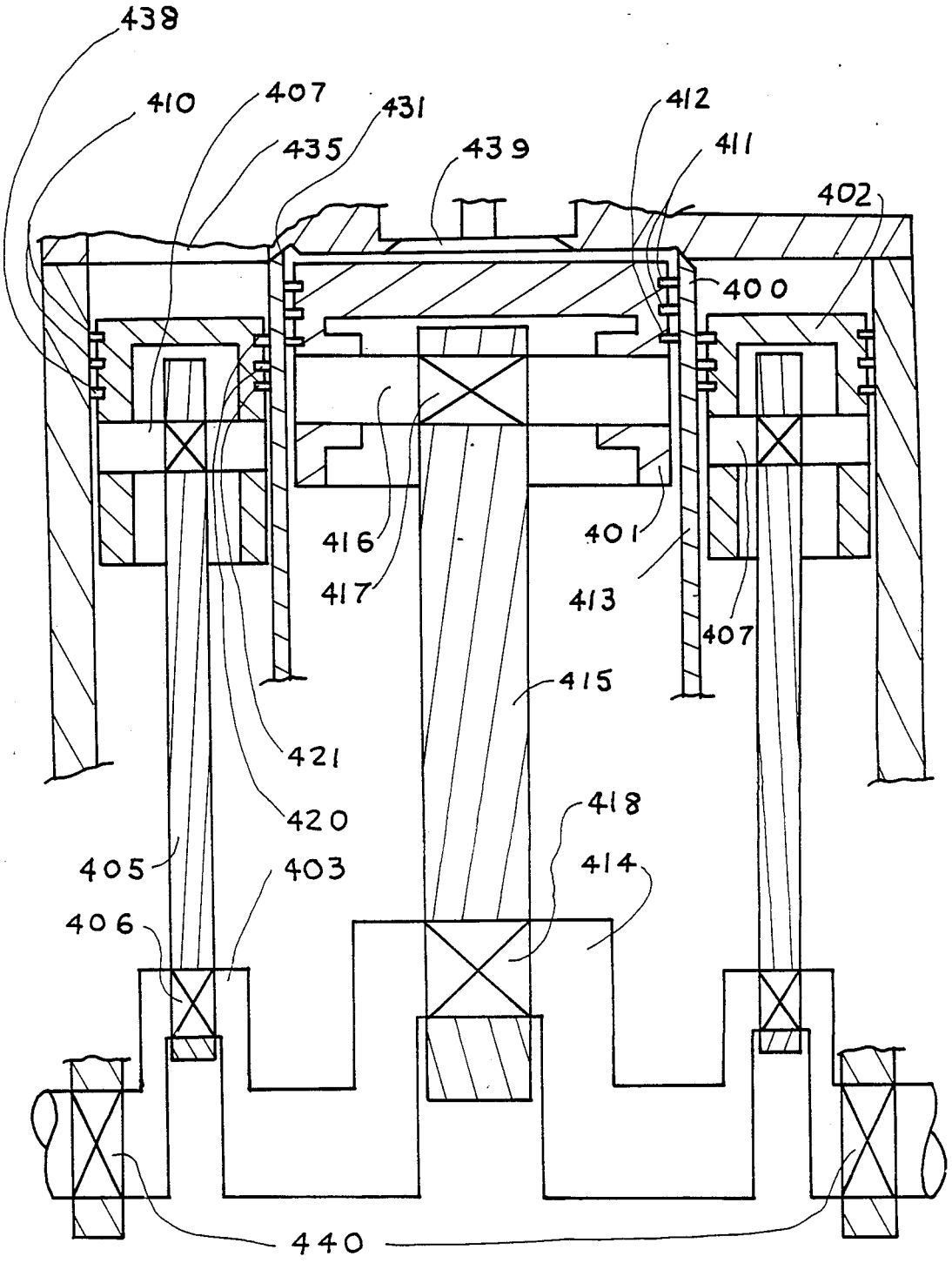
FIG. 4 is a form of the engine combustion, expansion and exhaust chamber wherein both working and auxiliary pistons are crank driven.
Figure 5A:
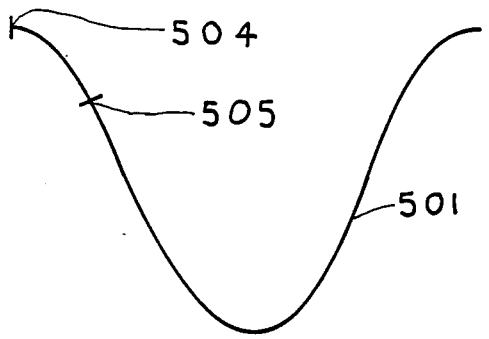
FIGS. 5A, B and C show timing relationships for the FIG. 4 chamber.
Figure 5B:
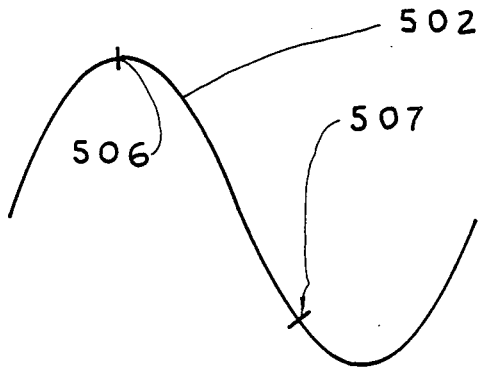
Figure 5C:
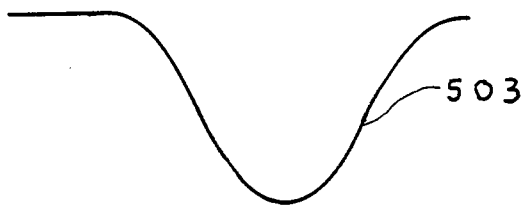

FIGS. 5A, B and C presents representative displacements of a working circular piston, an auxiliary annular piston and the auxiliary valve. The exhaust and inlet openings and ignition timing for the configuration defined in FIG. 4 during the intake, combustion, expansion and exhaust of the working chamber chamber. FIG. 5A depicts the displacement 501 of the working piston as it moves between TDC and BDC. The inlet valve opens at 504 and closes at 505. During the time said inlet is open the pressurized charge flows into the working chamber. Said charge being pressurized by suitable means with (compressor) or without (charging piston properly phased to the working piston e.g., reaching TDC at about 505) plenum. FIG. 5B depicts the auxiliary piston motion. The exhaust valve opens at 507 and remains open until 506 on the following cycle. 506 being at about the time the inlet to the working piston closes 505. FIG. 5C depicts the auxiliary valve motion. The auxiliary valve seals at about 504 and remains sealed until about 506 at which point the auxiliary valve withdraws permitting communication between the working and auxiliary chambers until about 504 of the following cycle. Exhaust port uncovers as the auxiliary piston approaches BDC, inlet port opens at about the working piston minimum volume condition and continues until the working piston is between 40 and 215 (FIG. 5C shows a 60 degree point for illustrative purposes the exact timing is dependent on a number of design choices) degrees past TDC at which time the inlet valve 439 closes. Ignition occurs about or prior to the sealing of the inlet 505.

Said auxiliary valve and head remaining sealed from when the working piston is at about TDC until charging and partial movement toward BDC by the center working piston. At a point 0 to 120 degrees after inlet valve 439 closure, the cam mechanism moves the auxiliary valve away from the head breaking the seal and permitting combustion products to flow from the chamber above the working piston into the chamber above the auxiliary piston and both the working and auxiliary pistons now combine to provide expansion.

Figure 6A:
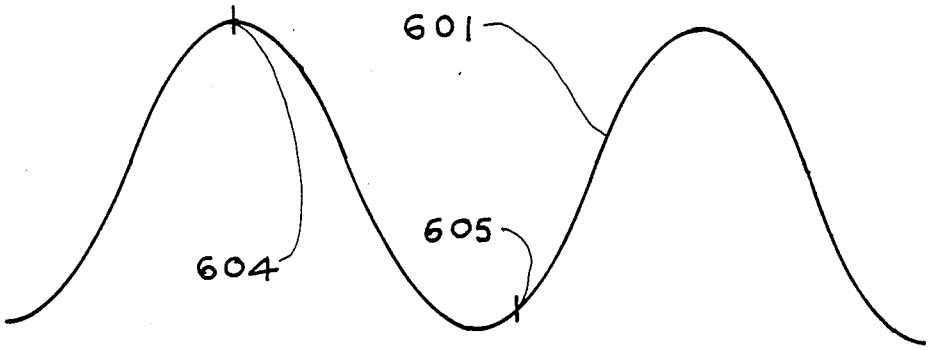
FIGS. 6A, B and C shows an alternative timing arrangement for the FIG. 4 chamber.
Figure 6B:
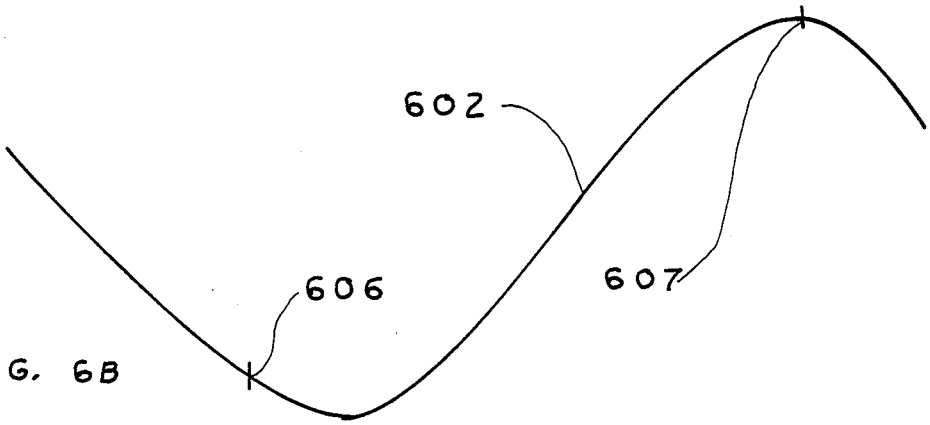
Figure 6C:
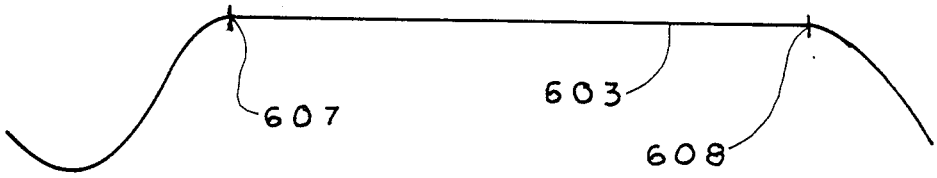

FIGS. 6A, B and C presents an alternative cycle's representative displacements of a working and auxiliary piston the exhaust and inlet openings and ignition timing for the configuration defined in FIG. 4. Note the working piston revolves 2 revolutions to each one of the auxiliary piston. Also the FIG. 4 mechanization is modified to provide for the proper volume (as is FIG. 1) in the working chamber when the working piston is at TDC. FIG. 6A deplicts the displacement 601 of the working piston as it moves between TDC and BDC. The inlet valve opens at 604 and closes at 605. During the time said inlet is open the partially pressurized charge flows into the working chamber. Said charge being partially pressurized by suitable means with (compressor) or without (charging piston properly phased to the working piston e.g., reaching TDC at about 605) plenum. FIG. 6B deplicts the auxiliary piston motion. The exhaust valve opens at 606 and remains open until 607. FIG. 6C deplicts the auxiliary valve motion. The auxiliary valve seals 607 at about 604 and remains sealed 608 until about 607 at which point the auxiliary valve withdraws permitting communication between the working and auxiliary chambers until about 604 of the following cycle. Exhaust port uncovers as the auxiliary piston approaches BDC, inlet port opens at about the working piston minimum volume condition and continues until the working piston is after BDC. Timing shown is for illustrative purposes the exact timing of 608 during the expansion stroke of the working piston is dependent on a number of design choices. Ignition occurs about or prior of the working piston arriving at TDC near the end of it's compression stroke. At a point after ignition and after the working piston during it's expansion stroke has moved 20 degrees from TDC and before it has moved 170 degrees past TDC, the cam mechanism moves the auxiliary valve away from the head breaking the seal and permitting combustion products to flow from the chamber above the working piston into the chamber above the auxiliary piston and both the working and auxiliary pistons now combine to provide expansion.

Figure 7:
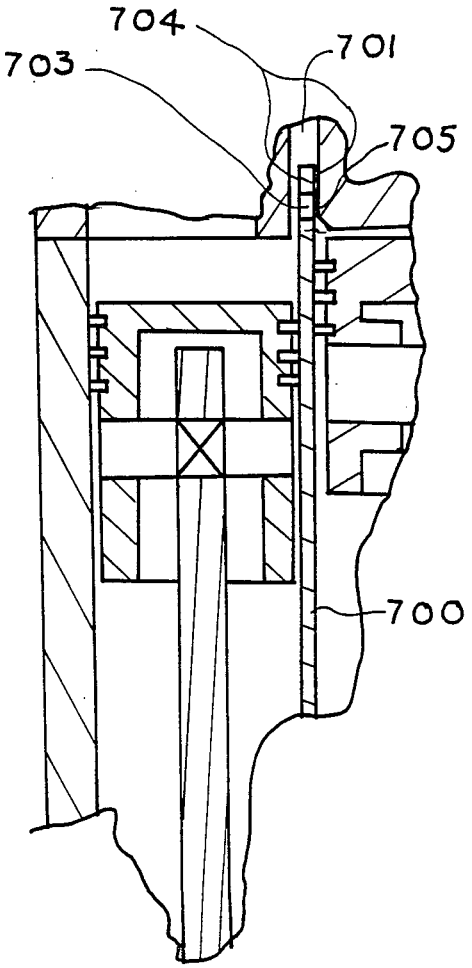
FIG. 7 shows an alternative auxiliary valve arrangement based on a 2 stroke port valve approach.

FIG. 7 is a partial view of the FIG. 4 configuration with the auxiliary valve based on 2 stroke engine port valve design with auxiliary valve 700 projecting into head cavity 701 and with valve ports 702 spaced circumferentially around the auxiliary valve such that the position of the auxiliary valve controls communication between the working and auxiliary chambers. The position of said auxiliary valve is controlled by a cam mechanism or by properly phased crank designs. With ring seals about the auxiliary valve inner and outer surfaces at the top 703 to prevent leakage into the head cavity 701 and seal at 704 to prevent leakage from the main chamber to the ports when the ports are in the cavity above seal 704.

It is also pointed out that where a charging piston is employed said charging piston can employ a reverse of the expanding piston concept to compress in both pistons with the final compression done in one chamber to limit the minimun trapped volume at a given clearance of the charging chamber.

What is claimed is:

1. The method of operation for the extraction of work from combusted products in two piston chambers hereafter referred to as working and auxiliary having a means of controlling isolation between the two said chambers, said method comprising of admitting a charge of carbureted air into both said chambers and compressing the charge from both said chambers into said working chamber, timing said auxiliary chamber piston to be at about TDC following a compression stroke as said working chamber piston on a compression stroke is approaching and within 45 degrees of TDC, isolating said working chamber from said auxiliary chamber when said auxiliary chamber piston is at substantially TDC, initiating combustion of said charge in said working chamber with said working chamber piston within 30 degrees of and before reaching TDC on said compression stroke, the compression ratio at working chamber piston TDC shall not exceed eighteen, expanding said combusted products by the working chamber piston until a point in the cycle after combustion is completed and before said working chamber piston is within 60 degrees of BDC, both said combustion and said expansion occurring while said working chamber is isolated from said auxiliary chamber, said combusted products are permitted to communicate freely to said auxiliary chamber, said auxiliary chamber piston being at about TDC and about to enter an expansion stroke as said communication is commenced, working chamber piston expansion ratio from TDC prior to communication being established shall not exceed four, said auxiliary chamber piston then expands said combusted products communicated from said working chamber, before the combined expansion of both said chambers reaches maximum expansion an exhaust valve between said chamber containing said combusted products and an exhaust manifold opens and said combusted products, except for residual gases, are exhausted.

2. The method of operation for the extraction of work from combusted products in two piston chambers hereafter referred to as working and auxiliary having a means of controlling isolation between the two said chambers, said method comprising of isolating said working chamber from said auxiliary chamber when said working chamber piston is at substantially TDC, admitting a charge of pressurized carbureted air into said working chamber as said working chamber piston moves toward BDC, closing a valve admitting said charge after said working piston is 40 or more degrees past TDC and before said working chamber piston reaches BDC, compression ratio at said valve closing shall not exceed eighteen, initiating combustion of said charge in said working chamber near the time said valve admitting said charge into said working chamber is closed, expanding said combusted products in said working chamber until a point in the cycle after combustion is completed and before said working piston has rotated 100 degrees past initial combustion, volumetric expansion from said closure of said valve admitting said charge into said working chamber of said combusted products in said working chamber prior to establishing communication between the working and auxiliary chambers shall not exceed four, said combusted products are permitted to communicate freely to said auxiliary chamber, said auxiliary chamber piston being at about TDC as said communication is commenced, said auxiliary chamber then expands said combusted products communicated to said auxiliary chamber from said working chamber, said auxiliary chamber total volumetric displacement shall not exceed the working chamber total volumetric displacement by greater than three times, before the combined expansion of both said chambers reaches maximum expansion an exhaust valve opens and said combusted products, except for residual gases, are exhausted.

3. The method of operation for the extraction of work from combusted products in two piston chambers hereafter referred to as working and auxiliary having a means of controlling isolation between the two said chambers, said method comprising of admitting a charge of air into both said chambers and compressing the charge from both said chambers into said working chamber, timing said auxiliary chamber piston to be at about TDC following a compression stroke as said working chamber piston on a compression stroke is approaching and within 45 degrees of TDC, isolating said working chamber from said auxiliary chamber when said auxiliary chamber piston is at substantially TDC, injecting fuel into said working chamber causing combustion with in 30 degrees of and before said working chamber piston reaches TDC on said compression stroke, expanding said combusted products by the working chamber piston until a point in the cycle after combustion is completed and before said working chamber piston is within 60 degrees of BDC, both said combustion and said expansion occurring while said working chamber is isolated from said auxiliary chamber, said combusted products are permitted to communicate freely to said auxiliary chamber, said auxiliary chamber piston being at about TDC and about to enter an expansion stroke as said communication is commenced, working chamber piston expansion ratio from TDC prior to communication being established shall not exceed one-third of said compression ratio, said auxiliary chamber piston then expands said combusted products communicated from said working chamber, before the combined expansion of both said chambers reaches maximum expansion condition an exhaust valve between said chamber containing said combusted products and an exhaust manifold opens and said combusted products, except for residual gases, are exhausted.

4. The method of operation for the extraction of work from combusted products in two piston chambers hereafter referred to as working and auxiliary having a means of controlling isolation between the two said chambers, said method comprising of isolating said working chamber from said auxiliary chamber when said working chamber piston is at substantially TDC, admitting a charge of pressurized air into said working chamber as said working chamber piston moves toward BDC, closing a valve admitting said charge after said working piston is 25 or more degrees past TDC and before said working chamber piston reaches BDC, initiating fuel injection into said working chamber causing combustion near the time the valve admitting the charge is closed, expanding said combusted products in said working chamber until a point in the cycle after combustion is completed and before said working piston has rotated 100 degrees past initial combustion, volumetric expansion from said closure of said valve admitting said charge into said working chamber of said combusted products in said working chamber prior to establishing communication between the working and auxiliary chambers shall not exceed one-third of said compression ratio, said combusted products are permitted to communicate freely to said auxiliary chamber, said auxiliary chamber piston being at about TDC as said communication is commenced, said auxiliary chamber then expands said combusted products communicated to said auxiliary chamber from said working chamber, said auxiliary chamber total volumetric displacement shall not exceed the working chamber total volumetric displacement by greater than three times, before the combined expansion of both said chambers reaches maximum expansion an exhaust valve between said chamber containing said combusted products and an exhaust manifold opens and said combusted products, expect for residual gases, are exhausted.

5. The method of operation for the extraction of work from combusted products in two chambers hereafter referred to as working and auxiliary having a means of controlling isolation between the two said chambers, said method comprising of isolating said working chamber from said auxiliary chamber when said working chamber piston is at substantially TDC, admitting a charge of pressurized air into said working chamber as said working chamber piston moves toward BDC, closing a valve admitting said charge after said working chamber piston is past BDC but before it is midway to TDC, compressing said charge in said working chamber, injecting fuel to initiate combustion of said charge before said working chamber piston reaches TDC on said compression stroke, expanding said combusted products in said working chamber until between a point in the cycle after combustion is completed and before said working chamber piston is within 60 degrees of BDC, said combusted products are permitted to communicate freely to said auxiliary chamber, said auxiliary chamber piston being at about TDC as said communication is commenced, volumetric expansion from said closure of said valve admitting said charge into said working chamber of said combusted products in said working chamber piston chamber prior to establishing communication between the working and auxiliary chambers shall not exceed one-third of said compression ratio, said auxiliary chamber piston then expands said combusted products communicated from said working chamber to said auxiliary chamber, before the combined expansion of both said chambers reaches maximum expansion an exhaust valve between said chamber containing said combusted products and an exhaust manifold opens and said combusted products, except for residual gases, are exhausted.

6. A method of operation as stated in 1 above, wherein the working chamber piston reciprocates within a sleeve valve and wherein said sleeve valve reciprocates within said auxiliary chamber piston.

7. A method of operation as stated in 2 above, wherein the working chamber piston reciprocates within a sleeve valve; wherein said sleeve valve reciprocates within the auxiliary chamber piston.

8. A method of operation as stated in 3 above, wherein the working chamber piston reciprocates within a sleeve valve and wherein said sleeve valve reciprocates within the auxiliary chamber piston.

9. A method of operation as stated in 4 above, wherein the working chamber piston reciprocates within a sleeve valve and wherein said sleeve valve reciprocates within the auxiliary chamber piston.

10. A method of operation as stated in 5 above, wherein the working chamber piston reciprocates within a sleeve valve and wherein said sleeve valve reciprocates within the auxiliary chamber piston.

* * * * *